US010811213B2

(12) United States Patent
Honda

(10) Patent No.: US 10,811,213 B2
(45) Date of Patent: Oct. 20, 2020

(54) X-RAY CT APPARATUS AND INSERT

(71) Applicant: Canon Medical Systems Corporation, Otawara-shi (JP)

(72) Inventor: Toyomasa Honda, Nasushiobara (JP)

(73) Assignee: CANON MEDICAL SYSTEMS CORPORATION, Otawara-shi (JP)

( * ) Notice: Subject to any disclaimer, the term of this patent is extended or adjusted under 35 U.S.C. 154(b) by 0 days.

(21) Appl. No.: 16/130,219

(22) Filed: Sep. 13, 2018

(65) Prior Publication Data

US 2019/0088439 A1 Mar. 21, 2019

(30) Foreign Application Priority Data

Sep. 15, 2017 (JP) ..... 2017-178171
Aug. 31, 2018 (JP) ..... 2018-163488

(51) Int. Cl.

| | |
|---|---|
| ***H01J 35/00*** | (2006.01) |
| ***H01J 35/14*** | (2006.01) |
| ***H01J 35/06*** | (2006.01) |
| ***H01J 35/30*** | (2006.01) |
| ***H01J 35/16*** | (2006.01) |
| ***H01J 35/10*** | (2006.01) |
| ***H05G 1/02*** | (2006.01) |

(52) U.S. Cl.

CPC ..... *H01J 35/14* (2013.01); *H01J 35/06* (2013.01); *H01J 35/106* (2013.01); *H01J 35/16* (2013.01); *H01J 35/305* (2013.01); *H05G 1/025* (2013.01); *H01J 2235/1283* (2013.01); *H01J 2235/166* (2013.01)

(58) Field of Classification Search

CPC ..... H01J 35/105; H01J 35/16; H01J 35/305
See application file for complete search history.

(56) References Cited

U.S. PATENT DOCUMENTS

| | | | |
|---|---|---|---|
| 7,236,571 | B1 | 6/2007 | Kendall et al. |
| 2004/0066901 | A1 | 4/2004 | Artig et al. |
| 2017/0372865 | A1 | 12/2017 | Ishihara et al. |

FOREIGN PATENT DOCUMENTS

| | | |
|---|---|---|
| JP | 2000-157532 | 6/2000 |
| JP | 2001-273998 | 10/2001 |
| JP | 2004-146295 | 5/2004 |
| JP | 2013-145747 | 7/2013 |
| JP | 2016-18687 | 2/2016 |
| JP | 2016-162525 | 9/2016 |
| JP | 2017-74361 | 4/2017 |

*Primary Examiner* — Dani Fox
(74) *Attorney, Agent, or Firm* — Oblon, McClelland, Maier & Neustadt, L.L.P.

(57) ABSTRACT

An X-ray CT apparatus according to an embodiment includes: a rotatable gantry base; a housing that is fixed to the gantry base and that has an opening; an insert that is removably located in the housing and that includes a cathode that generates a thermal electron and an anode that receives collision of the thermal electron to generate an X-ray; and a blower that is removably attached to the side of the opening to flow air into the housing.

10 Claims, 10 Drawing Sheets

X-RAY CT APPARATUS AND INSERT

CROSS-REFERENCE TO RELATED APPLICATIONS

This application is based upon and claims the benefit of priority from Japanese Patent Application No. 2017-178171, filed on Sep. 15, 2017; and Japanese Patent Application No. 2018-163488, filed on Aug. 31, 2018, the entire contents of which are incorporated herein by reference.

FIELD

Embodiments described herein relate generally to an X-ray CT apparatus and an insert.

BACKGROUND

An insert used by an X-ray CT apparatus to generate X-rays includes components such as an anode (target) and a bearing. These components have their operating lives, and long-term usage causes their degradation, and eventually the insert breaks down. Then, the broken-down insert needs to be replaced. Furthermore, as the insert produces heat when it generates X-rays, it is usually located in a housing that is filled with coolant.

Here, when the insert breaks down, it is sufficient to replace the insert; however, it is difficult to replace only the insert in the housing that is filled with the coolant, and it is usually replaced together with peripheral components such as the housing. That is, even when only the insert breaks down, components that are not broken-down are also replaced, and therefore components are costly. Furthermore, replaced components are large and heavy, which results in high workloads during a replacing work. For example, when the housing having a lead plate to shield against X-rays and the coolant are also replaced, replaced components may be several dozens of kilograms, and therefore replacing works need human resources.

DETAILED DESCRIPTION

An X-ray CT apparatus comprises a rotatable gantry base, a housing, an insert, and a blower. The housing is fixed to the gantry base and has an opening. The insert is removably located in the housing and includes a cathode that generates a thermal electron and an anode that receives collision of the thermal electron to generate an X-ray. The blower is removably attached to a side of the opening to flow air into the housing.

With reference to the drawings, a detailed explanation is given below of an embodiment of the X-ray CT apparatus and the insert. The X-ray CT apparatus including the insert is explained below as an example.

Figure 1:
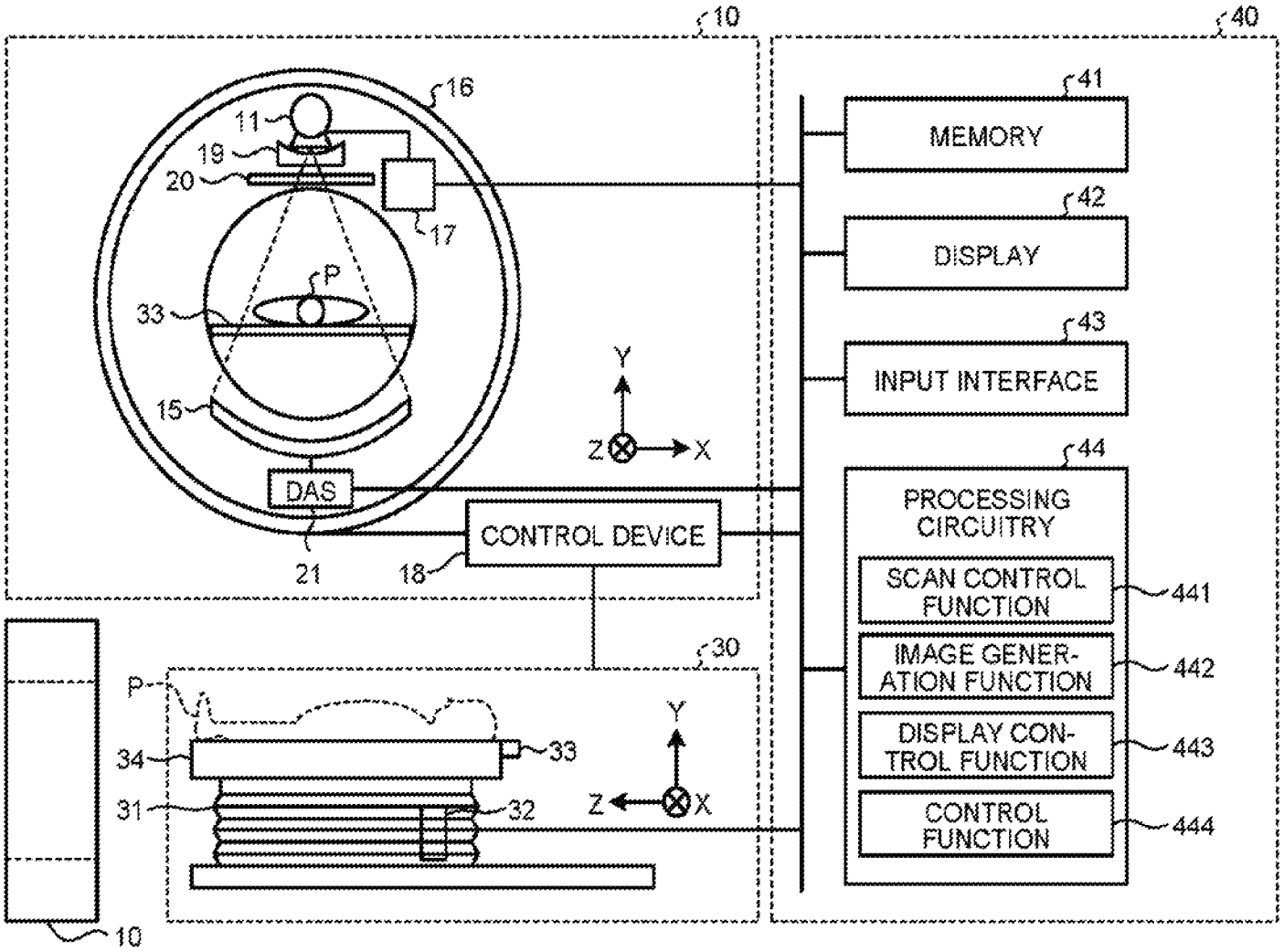
FIG. 1 is a block diagram that illustrates an example of the configuration of an X-ray CT apparatus according to a first embodiment.

With reference to FIG. 1, a configuration of an X-ray CT apparatus 1 according to a first embodiment is explained. FIG. 1 is a block diagram that illustrates an example of the configuration of the X-ray CT apparatus 1 according to the first embodiment. As illustrated in FIG. 1, the X-ray CT apparatus 1 includes a gantry 10, a couch 30, and a console 40. Here, in FIG. 1, the Z-axis direction is the rotation axis of a rotary frame 16 when it is not tilted or the longitudinal direction of a tabletop 33 of the couch 30. Furthermore, the X-axis direction is the axis direction that is perpendicular to the Z-axis direction and that is horizontal to the floor surface. Moreover, the Y-axis direction is the axis direction that is perpendicular to the Z-axis direction and that is vertical to the floor surface.

The gantry 10 includes an insert 11, an X-ray detector 15, the rotary frame 16, an X-ray high-voltage device 17, a control device 18, a wedge 19, a collimator 20, and data acquisition circuitry 21.

The insert 11 (X-ray tube) is a vacuum tube that includes: a cathode (filament) that generates thermal electrons; and an anode (target) that receives collision of thermal electrons to generate X-rays. The insert 11 uses a high voltage supplied from the X-ray high-voltage device 17 to emit thermal electrons from the cathode toward the anode. Furthermore, the insert 11 includes a fixer that allows attachment to or detachment from the rotary frame 16 (gantry base) of the gantry 10, and it is provided within an undepicted housing 12. The insert 11 and the housing 12 are described later.

The X-ray detector 15 detects X-rays that are emitted from the insert 11 and are passed through the subject P and outputs signals that correspond to the amount of detected X-rays to the data acquisition circuitry 21. The X-ray detector 15 includes for example multiple X-ray detecting element arrays in which a plurality of X-ray detecting elements is arranged in a channel direction along a single circular arc with the focal point of the insert 11 at a center. The X-ray detector 15 has a configuration such that, for example, a plurality of X-ray detecting element arrays with a plurality of X-ray detecting elements arranged in a channel direction is arranged in a slice direction (array direction, row direction). Furthermore, the X-ray detector 15 is, for example, an indirect-conversion type detector that includes a grid, a scintillator array, and an optical sensor array. The scintillator array includes a plurality of scintillators. The scintillator includes a scintillator crystal that outputs light with the photon quantity that corresponds to the amount of incident X-rays. The grid is located on the surface at the X-ray incident side of the scintillator array, and it includes an X-ray shielding plate that absorbs scattered X-rays. The optical sensor array has a function to conduct conversion into electric signals in accordance with the amount of light from a scintillator and it includes, for example, an optical sensor such as a photomultiplier tube (photomultiplier: PMT). Furthermore, the X-ray detector 15 may be a direct-conversion type detector including a semiconductor device that converts incident X-rays into electric signals.

The rotary frame 16 (gantry base) is a circular frame that supports the insert 11 and the X-ray detector 15 such that they are opposed to each other and that rotates the insert 11 and the X-ray detector 15 through the control device 18. For example, the rotary frame 16 is a cast that is made of aluminum. Furthermore, in addition to the insert 11 and the X-ray detector 15, the rotary frame 16 may also support the X-ray high-voltage device 17 and the data acquisition circuitry 21. Furthermore, the rotary frame 16 may also support various components that are not illustrated in FIG. 1. Hereafter, the rotary frame 16 and part that moves and rotates together with the rotary frame 16 in the gantry 10 are also referred to as a rotary unit.

Furthermore, detection data generated by the data acquisition circuitry 21 is transmitted from a transmitter including a light emitting diode (LED) provided in the rotary frame 16 to a receiver including a photo diode provided in a non-rotary section of the gantry 10 through optical communications and is transferred to the console 40. Here, the non-rotary section is, for example, a fixing frame that rotatably supports the rotary frame 16. Furthermore, as the method for transmitting detection data from the rotary frame 16 to a non-rotary section in the gantry 10, any method may be used in addition to optical communications as long as it is non-contact type data transmission.

The X-ray high-voltage device 17 includes: a high-voltage generation device that includes electric circuitry such as a transformer and a rectifier and generates a high voltage applied to the insert 11; and an X-ray control device that controls an output voltage in accordance with X-rays emitted from the insert 11. The high-voltage generation device may be a transformer type or an inverter type. Furthermore, the X-ray high-voltage device 17 may be provided in the rotary frame 16 or may be provided in an undepicted fixing frame.

The control device 18 includes driving mechanisms such as a motor and an actuator and circuitry that controls the mechanism. The control device 18 receives input signals from an input interface 43, an input interface provided in the gantry 10, or the like, and controls operation of the gantry 10 and the couch 30. For example, the control device 18 controls rotation of the rotary frame 16, tilt of the gantry 10, operation of the couch 30 and the tabletop 33, and the like. With regard to control to tilt the gantry 10, for example, the control device 18 rotates the rotary frame 16 with the axis parallel to the X-axis direction at the center on the basis of input inclination angle (tilt angle) information. Furthermore, the control device 18 may be provided in the gantry 10 or may be provided in the console 40.

The wedge 19 is a filter for adjusting the amount of X-rays emitted from the insert 11. Specifically, the wedge 19 is a filter that transmits and attenuates X-rays emitted from the insert 11 so that X-rays emitted from the insert 11 to the subject P have a predetermined distribution. For example, the wedge 19 is a wedge filter or a bow-tie filter, and it is formed by processing aluminum, or the like, to have a predetermined target angle or a predetermined thickness.

The collimator 20 is a lead plate, or the like, which narrows down the irradiation range of X-rays that have transmitted through the wedge 19, and it forms slits by combining multiple lead plates, or the like. The numerical aperture and the position of the collimator 20 are adjusted by undepicted collimator adjustment circuitry. Thus, the irradiation range of X-rays generated by the insert 11 is adjusted.

The data acquisition circuitry 21 is a DAS (data acquisition system). The data acquisition circuitry 21 includes: an amplifier that performs an amplification process on electric signals output from each X-ray detecting element of the X-ray detector 15; and an A/D converter that converts electric signals into digital signals, and it generates detection data. The data acquisition circuitry 21 is implemented by using, for example, a processor.

The couch 30 is an apparatus on which the subject P, which is the target to be scanned, is placed and moved, and it includes a base 31, a couch driving device 32, the tabletop 33, and a support frame 34. The base 31 is a chassis that movably supports the support frame 34 in a vertical direction. The couch driving device 32 is a driving mechanism that moves the tabletop 33 on which the subject P is placed in the long axis direction of the tabletop 33, and it includes a motor, an actuator, and the like. The tabletop 33 provided on the top of the support frame 34 is a plate on which the subject P is placed. Furthermore, the couch driving device 32 may move the support frame 34 as well as the tabletop 33 in the long axis direction of the tabletop 33.

The console 40 includes a memory 41, a display 42, the input interface 43, and processing circuitry 44.

The memory 41 is implemented by using, for example, a semiconductor memory device such as a RAM (random access memory) or a flash memory, a hard disk, or an optical disk. For example, the memory 41 stores projection data or reconstruction image data. Furthermore, for example, the memory 41 stores programs for circuitry included in the X-ray CT apparatus 1 to perform their functions.

The display 42 presents various types of information. For example, the display 42 outputs CT images generated by the processing circuitry 44, the GUI (graphical user interface) for receiving various operations from an operator, and the like. For example, the display 42 is a liquid crystal display or a CRT (cathode ray tube) display.

The input interface 43 receives various input operations from an operator, converts the received input operation into electric signals, and outputs them to the processing circuitry 44. For example, the input interface 43 receives a collection condition for collecting projection data, a reconstruction condition for reconstructing CT image data, an image processing condition for generating post-processing images from CT images, and the like, from an operator. For example, the input interface 43 is implemented by using a mouse, keyboard, trackball, switch, button, joystick, or touch panel.

The processing circuitry 44 controls the overall operation of the X-ray CT apparatus 1. For example, the processing circuitry 44 includes a scan control function 441, an image generation function 442, a display control function 443, and a control function 444. The processing circuitry 44 is implemented by using, for example, a processor.

For example, the processing circuitry 44 reads the program that corresponds to the scan control function 441 from the memory 41 and executes it to control the X-ray CT apparatus 1 so as to conduct scan. Here, the scan control function 441 is capable of conducting scan by using various methods such as conventional scan, helical scan, or step-and-shoot methods.

Specifically, the scan control function 441 controls the couch driving device 32 so as to move the subject P into the capturing hole of the gantry 10. Furthermore, the scan control function 441 controls the X-ray high-voltage device 17 so as to supply a high voltage to the insert 11. Furthermore, the scan control function 441 adjusts the numerical aperture and the position of the collimator 20. Furthermore, the scan control function 441 controls the control device 18 so as to rotate the rotary unit including the rotary frame 16. Moreover, the scan control function 441 causes the data acquisition circuitry 21 to acquire projection data.

Furthermore, for example, the processing circuitry 44 reads the program that corresponds to the image generation function 442 from the memory 41 and executes it, thereby generating data that is obtained by performing preprocessing, such as logarithmic conversion process, offset correction process, inter-channel sensitivity correction process, or beam hardening correction, on detection data output from the data acquisition circuitry 21. Here, data (detection data) before preprocessing is performed and data after preprocessing is performed are collectively referred to as projection data in some cases. Furthermore, for example, the image generation function 442 generates CT image data. Specifically, the image generation function 442 conducts a reconstruction process by using a filter-correction back projection technique, a successive approximation reconstruction technique, or the like, on projection data on which preprocessing has been conducted, thereby generating CT image data. Furthermore, the image generation function 442 converts CT image data into cross-sectional image data at any cross-sectional surface or three-dimensional image data in accordance with input operation received from an operator via the input interface 43.

Furthermore, for example, the processing circuitry 44 reads the program that corresponds to the display control function 443 from the memory 41 and executes it, thereby presenting the CT image on the display 42. Furthermore, for example, the processing circuitry 44 reads the program that corresponds to the control function 444 from the memory 41 and executes it, thereby controlling various functions of the processing circuitry 44 in accordance with input operation received from an operator through the input interface 43.

Here, in the case illustrated in FIG. 1, processing functions, i.e., the scan control function 441, the image generation function 442, the display control function 443, and the control function 444, are implemented by the single processing circuitry 44; however, this is not a limitation on embodiments. For example, the processing circuitry 44 may be configured by combining multiple independent processors so that each processor executes each program to perform each processing function. Furthermore, each processing function provided in the processing circuitry 44 may be performed by being distributed or combined in one or more processing circuits as appropriate.

The term "processor" used in the above explanation means, for example, a CPU (central processing unit), a GPU (graphics processing unit), or a circuit, such as an application specific integrated circuit (ASIC), a programmable logic device (e.g., a simple programmable logic device (SPLD), a complex programmable logic device (CPLD), or a field programmable gate array (FPGA)). The processor reads a program stored in the memory 41 and executes it, thereby implementing the function. Furthermore, instead of storing programs in the memory 41, a configuration may be such that programs are directly installed in a circuit of a processor. In this case, the processor reads a program installed in the circuit and executes it, thereby implementing the function. Furthermore, with regard to each processor according to the present embodiment, each processor is not always configured as a single circuit but also configured as a single processor by combining multiple independent circuits so that its function is implemented.

Figure 2:
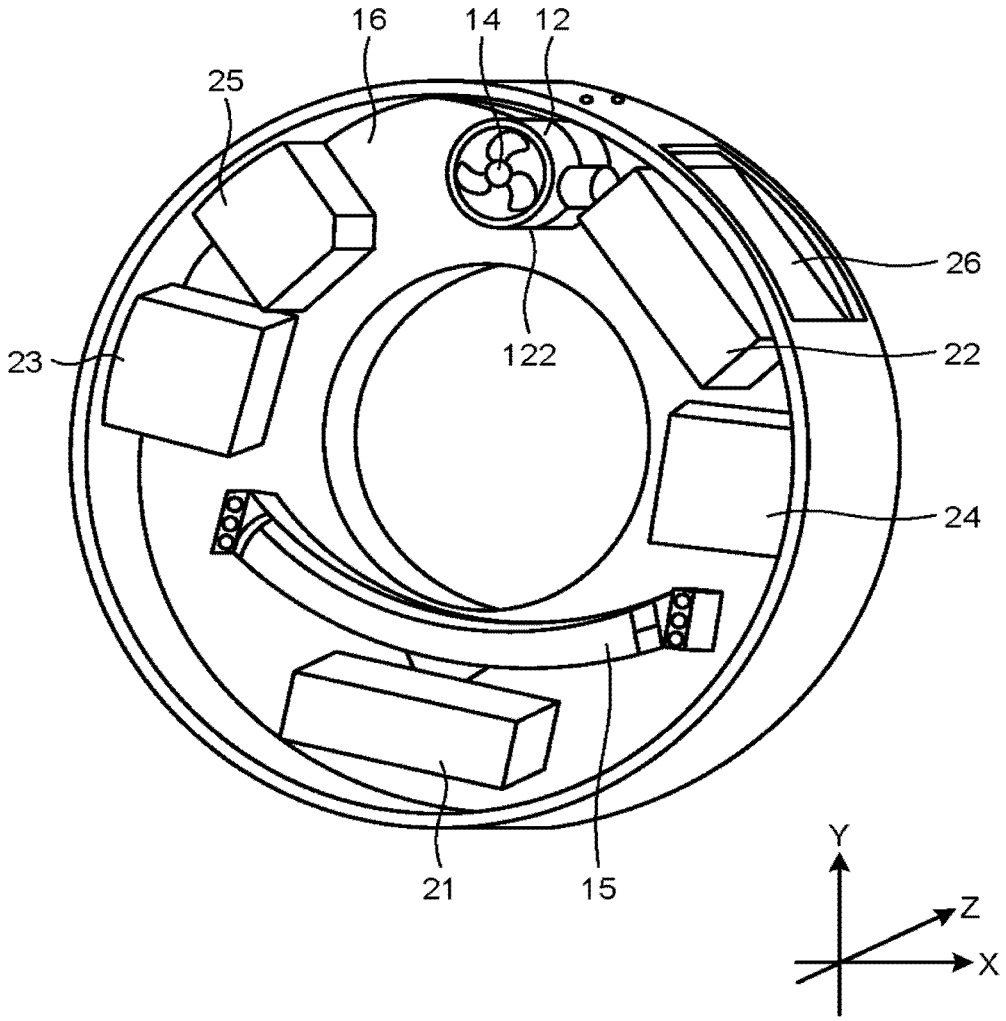
FIG. 2 is a diagram that illustrates an example of a rotary unit of the X-ray CT apparatus according to the first embodiment.

Next, with reference to FIG. 2, a rotary unit in the X-ray CT apparatus 1 is explained. FIG. 2 is a diagram that illustrates an example of the rotary unit of the X-ray CT apparatus 1 according to the first embodiment. The rotary unit illustrated in FIG. 2 is a part that rotates and moves in the gantry 10, and it is supported by, for example, an undepicted fixing frame.

As illustrated in FIG. 2, the rotary unit includes, in addition to the rotary frame 16, the housing 12, a blower 14, the X-ray detector 15, the data acquisition circuitry 21, a cooling device 22, a power source unit 23, a power source unit 24, a power control unit 25, a heat release opening 26, and the like. Furthermore, the rotary unit includes the insert 11 that is not illustrated, a stator coil 13, and the like.

The power source unit 23 and the power source unit 24 are examples of the X-ray high-voltage device 17, and they supply a tube voltage to the insert 11. Furthermore, the power control unit 25 controls the power source unit 23 and the power source unit 24.

As illustrated in FIG. 2, the cooling device 22 is provided such that it abuts the housing 12, and it cools heat generated when the insert 11 in the housing 12 generates X-rays. For example, the cooling device 22 includes a pump and a radiator, and it supplies coolant L1 to the insert 11. Here, the coolant L1 is, for example, water or oil. For example, first, the insert 11 cools an anode 112 in FIG. 3 by using the coolant L1 that is supplied from the cooling device 22 when X-rays are generated and delivers the coolant L1 with the temperature increased to the cooling device 22. After the cooling device 22 cools the coolant L1 with the temperature increased by using the radiator, it supplies the coolant L1 to the insert 11 again. The heat release opening 26 releases the heat generated in the cooling device 22 to outside.

As illustrated in FIG. 2, the blower 14 is fixed to the housing 12 to flow air into the housing 12. Inside the housing 12, the insert 11 and the stator coil 13 are provided. Here, as illustrated in FIG. 2, the housing 12 includes an X-ray window 122 at the position opposed to the X-ray detector 15. X-rays irradiated by the insert 11 are emitted to the subject P through the X-ray window 122, and X-rays passed through the subject P are detected by the X-ray detector 15. The insert 11, the housing 12, the stator coil 13, and the blower 14 are described later.

Under the control of the scan control function 441, the insert 11 in the rotary unit emits X-rays while rotating and moving around the subject P in accordance with rotation of the rotary unit. For example, when the gantry 10 is not tilted, the rotary unit rotates around the rotation axis parallel to the Z axis so that the insert 11 continuously emits X-rays to the subject P that is located at the rotation center. Furthermore, the X-ray detector 15 in the rotary unit detects X-rays passed through the subject P while rotating around the subject P in accordance with rotation of the rotary unit, and it outputs electric signals to the data acquisition circuitry 21. Furthermore, the data acquisition circuitry 21 in the rotary unit generates projection data in accordance with electric signals output from the X-ray detector 15 and transmits them to the processing circuitry 44. Then, the image generation function 442 generates CT image data on the basis of projection data transmitted from the rotary unit.

Figure 3:
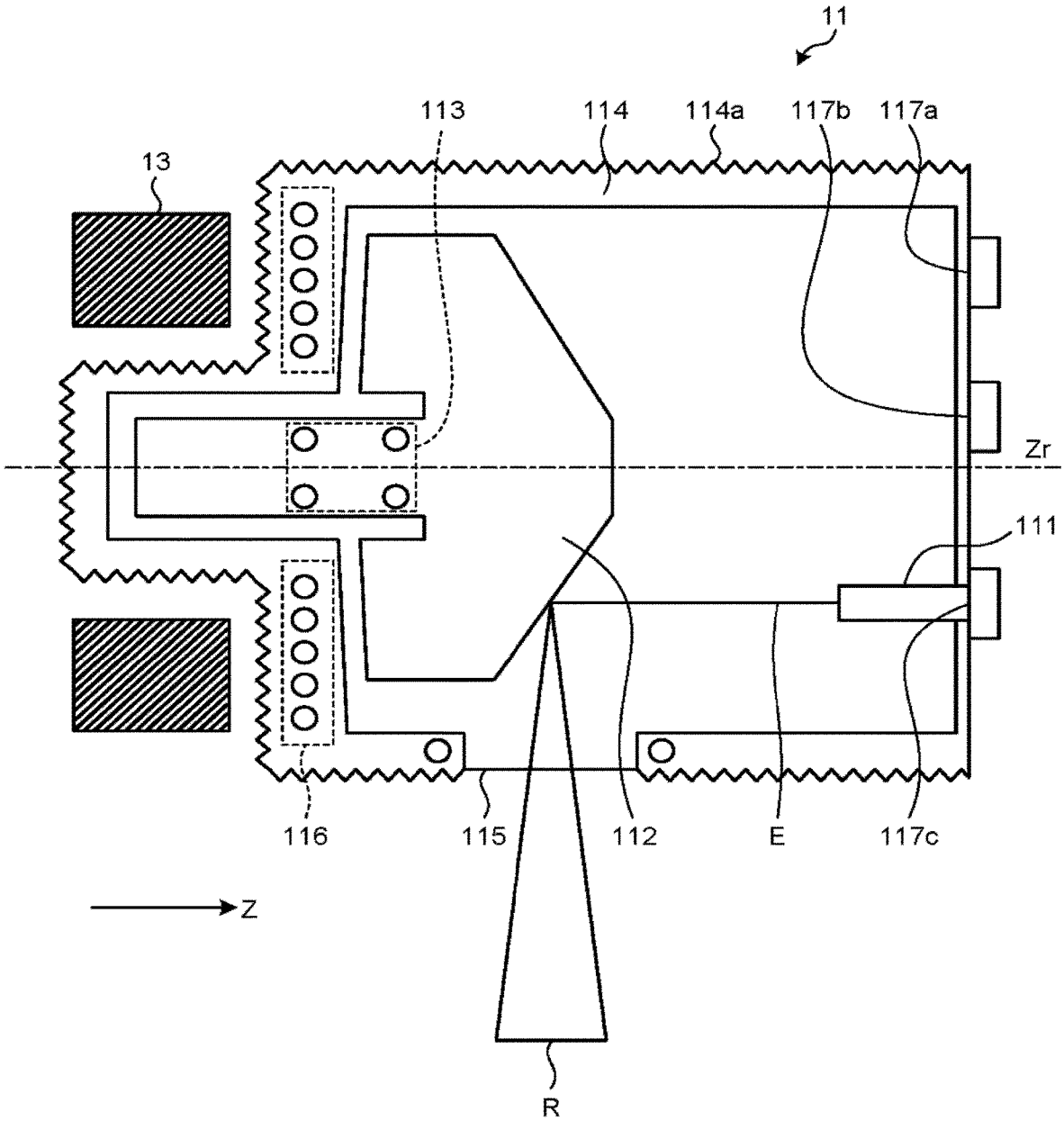
FIG. 3 is a diagram that illustrates an example of an insert and a stator coil according to the first embodiment.

Next, with reference to FIG. 3, the insert 11 and the stator coil 13 are explained. FIG. 3 is a diagram that illustrates an example of the insert 11 and the stator coil 13 according to the first embodiment. Here, FIG. 3 illustrates a cross-sectional surface of the insert 11 and the stator coil 13 on a plane including a rotation axis Zr described later and an X-ray window 115. As illustrated in FIG. 3, the insert 11 includes a cathode ill, the anode 112, a bearing 113, a chassis 114, the X-ray window 115, hollow 116 through which the coolant L1 passes, a fixer 117*a*, a fixer 117*b*, and a fixer 117*c*.

As illustrated in FIG. 3, the cathode 111 generates a thermal electron E. The cathode 111 is a filament that is made of for example tungsten. Here, the thermal electron is an electron that is excited due to heat generated by the current flowing through the filament and is ejected outside of the filament.

The anode 112 receives collision of the thermal electron E emitted by the cathode 111 to generate an X-ray R. Specifically, a potential difference is first set between the cathode 111 and the anode 112. For example, the anode 112 is grounded and the electric potential of the cathode 111 is set to be minus so that a potential difference is set between the cathode 111 and the anode 112. Due to this potential difference, the thermal electron E emitted by the cathode 111 accelerates and hits the anode 112 so that the X-ray R is generated.

Here, the anode 112 is a rotator that rotates around the rotation axis Zr, and it is circular when viewed in the axial direction of the rotation axis Zr. Furthermore, as illustrated in FIG. 3, the anode 112 has a part with a large radius and a part with a small radius. Here, the radius of the anode 112 is the distance from the outer circumference of the anode 112 to the rotation axis Zr on the plane vertical to the rotation axis Zr. The part with a large radius is located on the +Z direction side of the anode 112, and it receives the thermal electron E emitted from the cathode 111 to generate the X-ray R. Here, as illustrated in FIG. 3, the part with a large radius has an umbrella-like shape where the radius becomes gradually smaller as it is located closer to the cathode 111. Furthermore, the part with a small radius is located on the −Z direction side of the anode 112, and it is supported by the bearing 113.

Here, the anode 112 is rotatably supported by the bearing 113, and it is rotated due to the rotating magnetic field generated by the stator coil 13. As the anode 112 is rotated, location heated due to collision of the thermal electron E is dispersed so that the anode 112 is prevented from being dissolved due to heat.

As illustrated in FIG. 3, the chassis 114 houses the cathode 111, the anode 112, and the bearing 113. For example, the chassis 114 is made of a metal. Furthermore, the chassis 114 includes the X-ray window 115 and the hollow 116 through which the coolant L1 passes. The X-ray window 115 allows passage of the X-ray R generated by the anode 112. Furthermore, the hollow 116, through which the coolant L1 passes, cools the anode 112 that is heated due to collision of the thermal electrons E. Furthermore, the outer surface of the chassis 114 is provided with grooves 114*a*. The grooves 114*a* are described later. Moreover, the fixer 117*a*, the fixer 117*b*, and the fixer 117*c* are attached to or detached from the rotary frame 16. Thus, the insert 11 is attached to or detached from the rotary frame 16.

Figure 4:
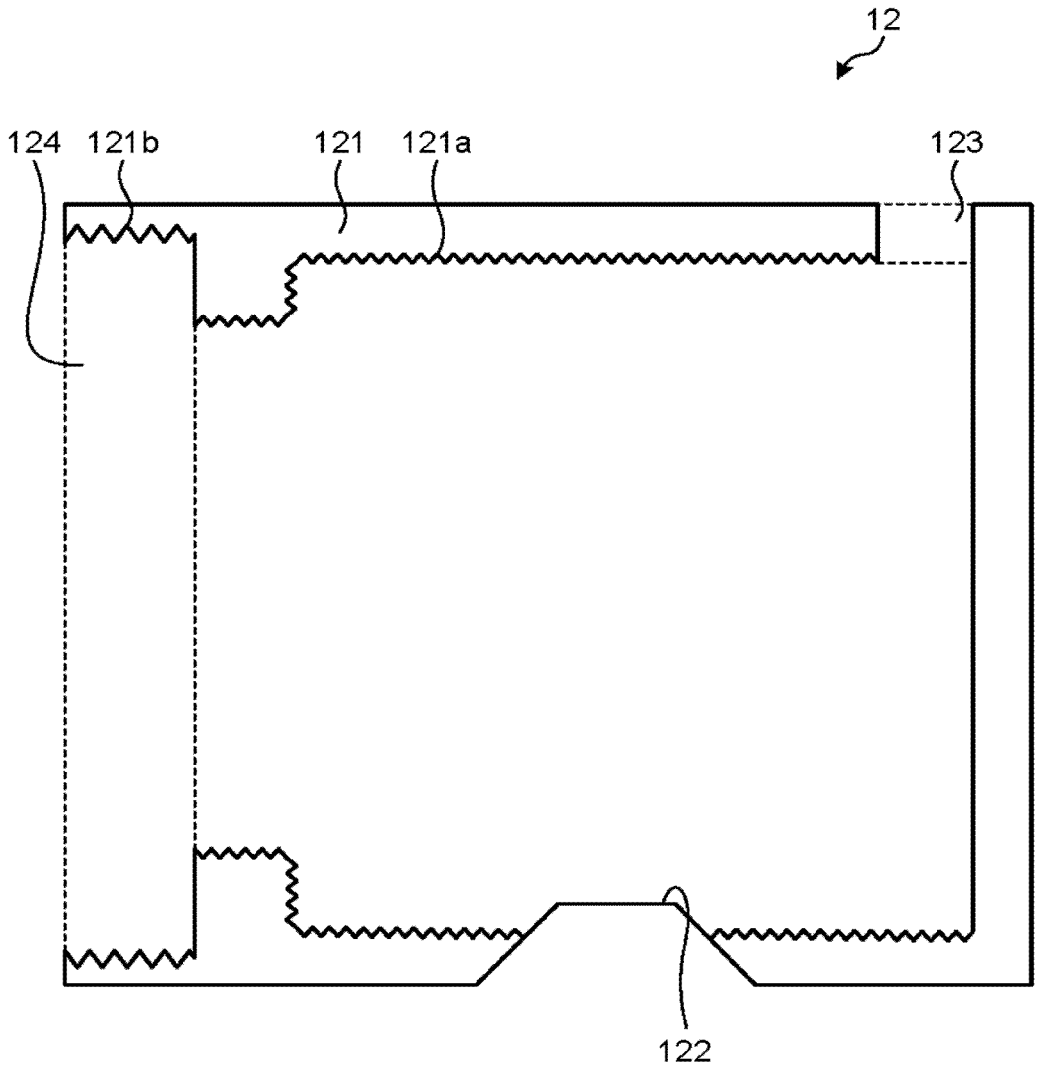
FIG. 4 is a diagram that illustrates an example of a housing according to the first embodiment.

Next, with reference to FIG. 4, the housing 12 is explained. FIG. 4 is a diagram that illustrates an example of the housing 12 according to the first embodiment. Here, FIG. 4 illustrates the cross-sectional surface of the housing 12 on the plane including the X-ray window 122 and a heat release opening 123 described later. As illustrated in FIG. 4, the housing 12 includes a chassis 121, the X-ray window 122, the heat release opening 123, and an opening 124. Furthermore, the insert 11 and the stator coil 13 may be accommodated inside the housing 12.

The chassis 121 is made of a material that is capable of shielding against the X-ray R generated by the anode 112 when the insert 11 is provided inside it. For example, the chassis 121 is made of a metal including lead. Furthermore, the inner surface of the chassis 121 is provided with grooves 121*a* and grooves 121*b*. The grooves 121*a* and the grooves 121*b* are described later.

The X-ray window 122 allows passage of the X-ray R that is generated by the anode 112 and passed through the X-ray window 115. The heat release opening 123 causes air flown into the housing 12 by the blower 14 described later to cool the insert 11 to be discharged to outside. The opening 124 is a space for taking the insert 11 and the stator coil 13 in and out of the chassis 121 and for attaching the blower 14.

Figure 5:
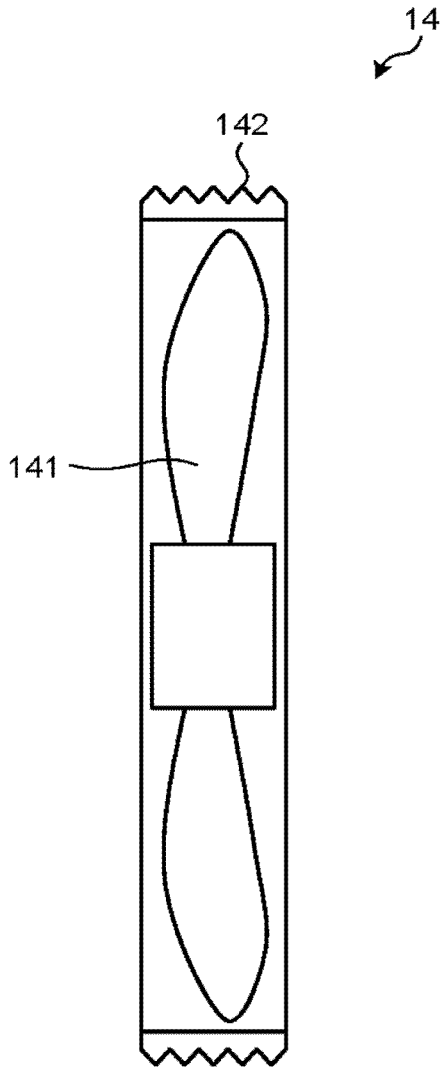
FIG. 5 is a diagram that illustrates an example of a blower according to the first embodiment.

Next, with reference to FIG. 5, the blower 14 is explained. FIG. 5 is a diagram that illustrates an example of the blower 14 according to the first embodiment. Here, FIG. 5 illustrates the cross-sectional surface of the blower 14 on the plane along the rotation axis of a fan 141. As illustrated in FIG. 5, the blower 14 includes the fan 141 and grooves 142. The fan 141 is made up of blades, a motor, and the like. For example, the fan 141 blows air when the blades are rotated by the motor that is driven with an electric power supplied. The grooves 142 are described later.

Here, the blades included in the blower 14 may shield against the X-ray R generated by the anode 112. For example, the blades included in the blower 14 are made of a material that is capable of shielding against the X-ray R, and they are configured such that they are overlapped with one another when viewed from the anode 112. For example, the blades included in the blower 14 are made of a plastic including an X-ray shielding metal. Here, a metal such as lead or tungsten may be selected as the X-ray shielding metal. Furthermore, as the plastic, any type of resin having a heat resistance property may be selected. For example, the blades included in the blower 14 are made of a resin such as polyethersulfone (PES), polysulfone, or polyimide. Moreover, the blades included in the blower 14 may be made of plastics (CFPR: carbon fiber reinforced plastics) that have a heat resistance property and that are reinforced with carbon fibers.

Figure 6:
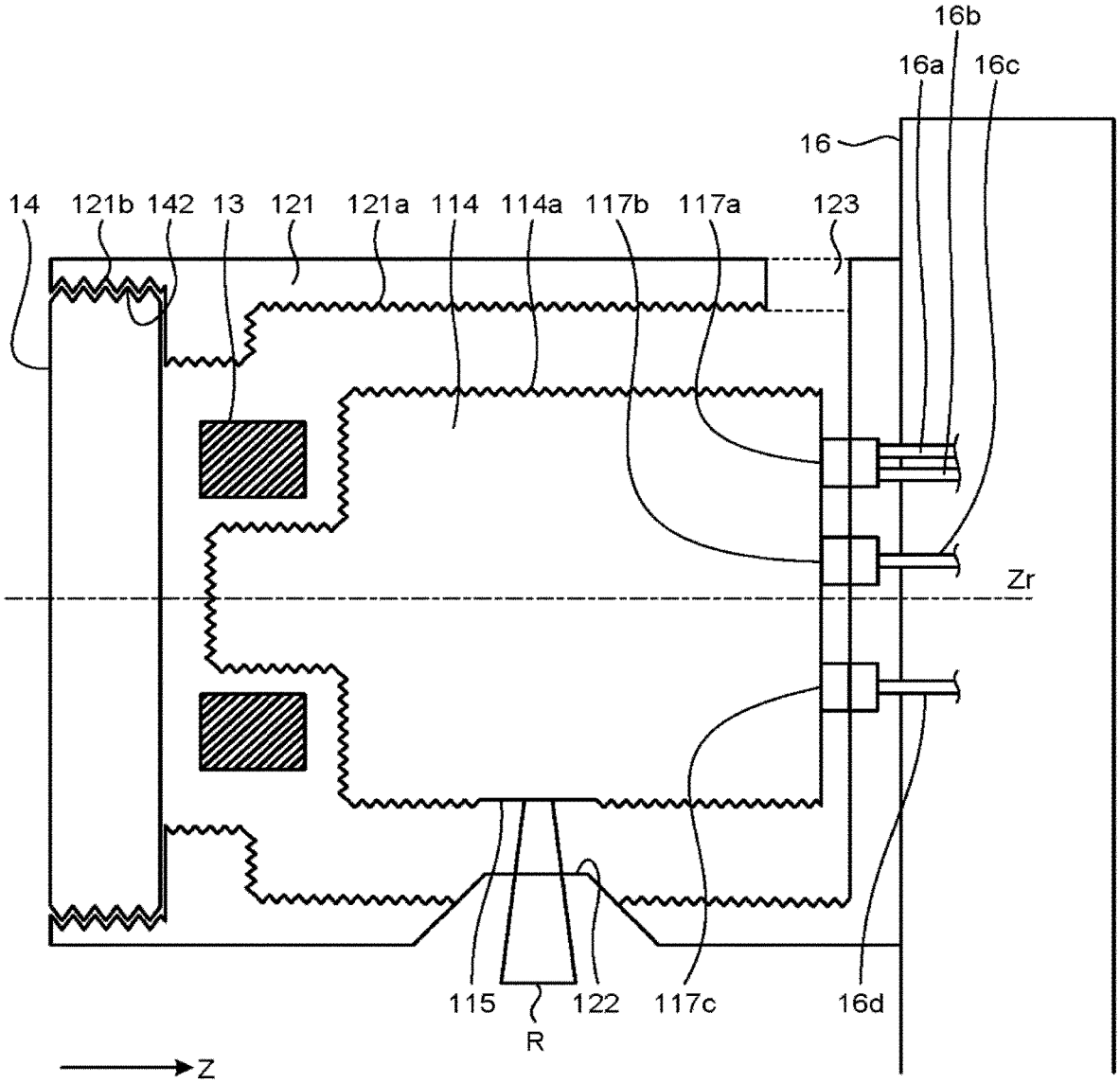
FIG. 6 is a diagram that illustrates an example of the insert, the housing, the stator coil, and the blower according to the first embodiment.

Each of the insert 11, the housing 12, the stator coil 13, and the blower 14 is explained above. Next, with reference to FIG. 6, an explanation is given of an assembled state and a usage state of the insert 11, the housing 12, the stator coil 13, and the blower 14. FIG. 6 is a diagram that illustrates an example of the insert 11, the housing 12, the stator coil 13, and the blower 14 according to the first embodiment. Here, FIG. 6 illustrates the cross-sectional surface of the housing 12 and the stator coil 13 on the plane including the rotation axis Zr, the X-ray window 115, and the X-ray window 122 and the external appearance of the insert 11 and the blower 14.

The housing 12 is fixed to the rotary frame 16. For example, the housing 12 is fixed to the rotary frame 16 with a bolt, a nut, or the like, which is not illustrated. Here, as illustrated in FIG. 6, the housing 12 is fixed such that the opening 124 is located on the side opposite to the side facing the rotary frame 16.

The insert 11 and the stator coil 13 are located inside the housing 12. Here, the insert 11 is fixed such that the position (X-ray focus) where the thermal electron E hits the anode 112, the X-ray window 115, and the X-ray window 122 are arranged in line. Thus, the X-ray R generated inside the insert 11 is emitted to the subject P who is located outside the housing 12.

Here, the insert 11 is fixed to the rotary frame 16 through the fixer 117*a*, the fixer 117*b*, and the fixer 117*c*. For example, the fixer 117*a* is connected to a hose 16*a* and a hose 16*b* in the rotary frame 16, the fixer 117*b* is connected to a cable 16*c* in the rotary frame 16, and the fixer 117*c* is connected to a cable 16*d* in the rotary frame 16 so that the insert 11 is fixed to the rotary frame 16.

For example, the fixer 117*a*, the hose 16*a*, and the hose 16*b* have terminals of connectors that ensure the flow of fluids through a connected hose. In this case, the terminal of the fixer 117*a* is pushed into the terminals of the hose 16*a* and the hose 16*b* so that the fixer 117*a* is connected to the hose 16*a* and the hose 16*b*.

Here, the hose 16*a* connected to the fixer 117*a* supplies the coolant L1 to the hollow 116. For example, the cooling device 22 illustrated in FIG. 2 first supplies the coolant L1, which is cooled by using the radiator, to the hose 16*a*. Next, the coolant L1 is supplied to the insert 11 from the hose 16*a* through the fixer 117*a*, and the hollow 116 cools the anode 112 by using the coolant L1. Then, the coolant L1, whose temperature has been increased after cooling the anode 112, is delivered to the cooling device 22 through the hose 16*b* and is again cooled. Here, the fixer 117*a* may have a structure to support the weight of the insert 11 in addition to ensuring the flow of the coolant L1 by connecting the hoses.

Furthermore, for example, the fixer 117*b* and the cable 16*c* have terminals of connectors for connecting a wire. In this case, the terminal of the fixer 117*b* is pushed into the terminal of the cable 16*c* so that the fixer 117*b* is connected to the cable 16*c*. Here, the cable 16*c* connected to the fixer 117*b* supplies an electric power to for example the stator coil 13. Here, the fixer 117*b* may have a structure to support the weight of the insert 11 in addition to ensuring the electric connection with the cable 16*c*.

Furthermore, for example, the fixer 117*c* and the cable 16*d* have terminals of connectors for connecting a wire. In this case, the terminal of the fixer 117*c* is pushed into the terminal of the cable 16*d* so that the fixer 117*c* is connected to the cable 16*d*. Here, the cable 16*d* connected to the fixer 117*c* supplies for example an electric power used by the cathode 111 to generate the thermal electron E. Here, the fixer 117*c* may have a structure to support the weight of the insert 11 in addition to ensuring the electric connection with the cable 16*d*.

Here, the terminal of each of the fixer 117*a*, the fixer 117*b*, the fixer 117*c*, the hose 16*a*, the hose 16*b*, the cable 16*c*, and the cable 16*d* is connected to the terminal in pair by being pushed into it and is disconnected from the terminal in pair by being pulled out from it. For example, the terminal of the fixer 117*a* is pushed into the terminals of the hose 16*a* and the hose 16*b* so that the fixer 117*a* is connected to the hose 16*a* and the hose 16*b*, and the terminal of the fixer 117*a* is pulled out from the terminals of the hose 16*a* and the hose 16*b* so that the fixer 117*a* is disconnected from the hose 16*a* and the hose 16*b*. Furthermore, for example, the terminal of the fixer 117*b* is pushed into the terminal of the cable 16*c* so that the fixer 117*b* is connected to the cable 16*c*, and the terminal of the fixer 117*b* is pulled out from the terminal of the cable 16*c* so that the fixer 117*b* is disconnected from the cable 16*c*. Furthermore, for example, the terminal of the fixer 117*c* is pushed into the terminal of the cable 16*d* so that the fixer 117*c* is connected to the cable 16*d*, and the terminal of the fixer 117*c* is pulled out from the terminal of the cable 16*d* so that the fixer 117*c* is disconnected from the cable 16*d*. That is, the fixer 117*a*, the fixer 117*b*, and the fixer 117*c* are attached to or detached from the rotary frame 16.

Furthermore, the fixer 117*a*, the fixer 117*b*, and the fixer 117*c* described above are examples of a fixer in claims. As illustrated in FIG. 6, the fixer 117*a*, the fixer 117*b*, and the fixer 117*c* are provided at one end of the insert 11 to fix the insert 11 to the rotary frame 16.

Furthermore, although FIG. 6 illustrates three fixers, i.e., the fixer 117*a*, the fixer 117*b*, and the fixer 117*c*, there may be any number of fixers. For example, there may be a case where the insert 11 further includes a fixer that supports the weight of the insert 11 at the same end of the fixer 117*a*, the fixer 117*b*, and the fixer 117*c*. Furthermore, for example, the insert 11 may combine the fixers in FIG. 6.

Furthermore, FIG. 6 illustrates a case where the insert 11 is fixed to the rotary frame 16 with the chassis 121 of the housing 12 interposed therebetween. However, there may be a case where the insert 11 is directly fixed to the rotary frame 16 without the chassis 121 of the housing 12 interposed therebetween. That is, the housing 12 may have an opening on the side abutting the rotary frame 16.

The blower 14 is fixed at the side of the opening 124 of the housing 12. For example, as illustrated in FIG. 6, the inner surface of the housing 12 at the side of the opening 124 is provided with the helical grooves 121*b*, and the surface of the blower 14 abutting the inner surface at the side of the opening 124 is provided with the helical grooves 142. In this case, the grooves 121*b* are engaged with the grooves 142 so that the blower 14 is fixed to the housing 12. More specifically, the blower 14 is rotated and pushed into the opening 124 of the housing 12 from the −Z direction side so that the grooves 121*b*, which are an internal thread, are engaged with the grooves 142, which are an external thread, whereby the blower 14 is fixed to the housing 12. Here, FIG. 6 illustrates a case where the inner surface of the housing 12 is provided with the grooves 121*b* and the outer surface of the blower 14 is provided with the grooves 142; however, this is not a limitation on the embodiment. For example, there may be a case where the outer surface of the housing 12 is provided with the grooves 121*b* and the inner surface of the blower 14 is provided with the grooves 142. Furthermore, the blower 14 and the housing 12 may be provided without the grooves 121*b* and the grooves 142. For example, the blower 14 may be fixed at the side of the opening 124 of the housing 12 by using a bolt, a nut, or the like.

Furthermore, the blower 14 may shield against the X-ray R generated by the anode 112. For example, the blower 14 includes a member that allows air flowing while shielding against the X-ray R on at least any one of the surface for delivering air out and the surface for receiving air. This member is configured such that multiple blades (slats) made of a metallic plate including lead, for example, are overlapped with one another when viewed from the anode 112 and a gap is provided between the blades to flow air.

As explained with reference to FIG. 6, each of the insert 11, the housing 12, the stator coil 13, and the blower 14 is assembled. In this assembled state, the insert 11 emits the X-ray R. Furthermore, while the insert 11 generates the X-ray R, the hollow 116, through which the coolant L1 passes, cools the anode 112. Here, in addition to cooling of the anode 112 with the hollow 116 through which the coolant L1 passes, the entire insert 11 needs to be cooled in some cases. Furthermore, cooling needs to be performed for heat generated by the stator coil 13.

Figure 7:
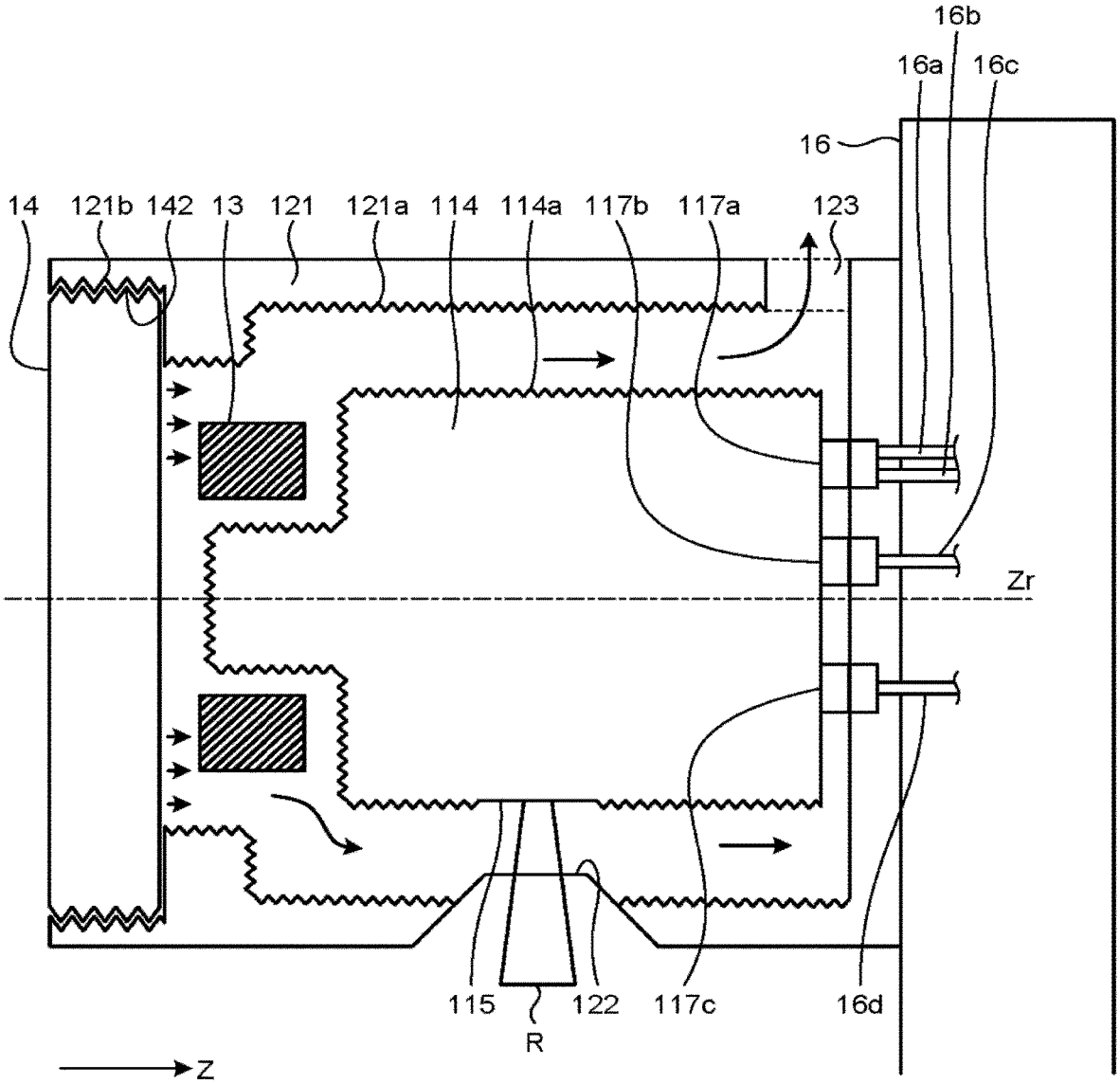
FIG. 7 is a diagram that illustrates cooling of the insert according to the first embodiment.

Therefore, in the X-ray CT apparatus 1, the insert 11 and the stator coil 13 are cooled with air that is flown into the housing 12 by the blower 14. For example, after air is flown into the housing 12 by the blower 14, it flows as indicated by an arrow in FIG. 7 to cool the insert 11 and the stator coil 13. Here, FIG. 7 is a diagram that illustrates cooling of the insert 11 according to the first embodiment. The direction indicated by the flow of air from the blower 14 to the heat release opening 123 is referred to as a flowing direction Zf below. That is, the flowing direction Zf is a direction indicated by an arrow in FIG. 7, and the direction changes depending on a position although it substantially matches the Z direction.

Specifically, after air is flown into the housing 12 by the blower 14, it flows between the inner surface of the housing 12 and the outer surfaces of the insert 11 and the stator coil 13 to cool the insert 11 and the stator coil 13 and then discharges through the heat release opening 123 of the housing 12 to outside, as illustrated in FIG. 7.

Here, as illustrated in FIG. 7, the chassis 114 of the insert 11 includes the grooves 114*a* that are perpendicular to the flowing direction Zf of air. Furthermore, as illustrated in FIG. 7, the chassis 121 of the housing 12 includes the grooves 121*a* that are perpendicular to the flowing direction Zf of air. Air flowing through the housing 12 flows as a laminar flow or a turbulent flow in accordance with the degree of viscosity of air and the cross-sectional area, shape, or the like, of a flow path, and when the wall surface of the flow path is coarse, a turbulent flow easily occurs as compared with a smooth wall surface. That is, as illustrated in FIG. 7, when the grooves 114*a* and the grooves 121*a* are provided, air blown by the blower 14 easily becomes a turbulent flow and flows inside the housing 12.

When the flow is a turbulent flow, a heat transfer coefficient of the air is substantially high as compared with a case where the flow is a laminar flow. Specifically, when the flow is a turbulent flow, air at a high temperature, which has been increased due to the heated insert 11, near the insert 11 and air at a low temperature located away from the insert 11 are stirred, and low-temperature air is delivered to the neighborhood of the insert 11, whereby heat removal of the insert 11 is facilitated.

Furthermore, there may be a case where the insert 11 and the housing 12 do not include the grooves 114*a* and the grooves 121*a*. For example, air flowing through the housing 12 sometimes becomes a turbulent flow in accordance with a cross-sectional area, shape, or the like, of a flow path even though the wall surface is smooth. In this case, the insert 11 and the housing 12 are capable of generating a turbulent flow without having the grooves 114*a* and the grooves 121*a* to cool the insert 11.

As described above, the insert 11, the housing 12, the stator coil 13, and the blower 14 are assembled and used to generate the X-ray R. Here, the anode 112 and the bearing 113 in the insert 11 are consumables, and they gradually deteriorate due to long-term usage. Furthermore, when the insert 11 breaks down due to deterioration of the anode 112 and the bearing 113, the insert 11 needs to be replaced. Replacement of the insert 11 is explained below.

Figure 8A:
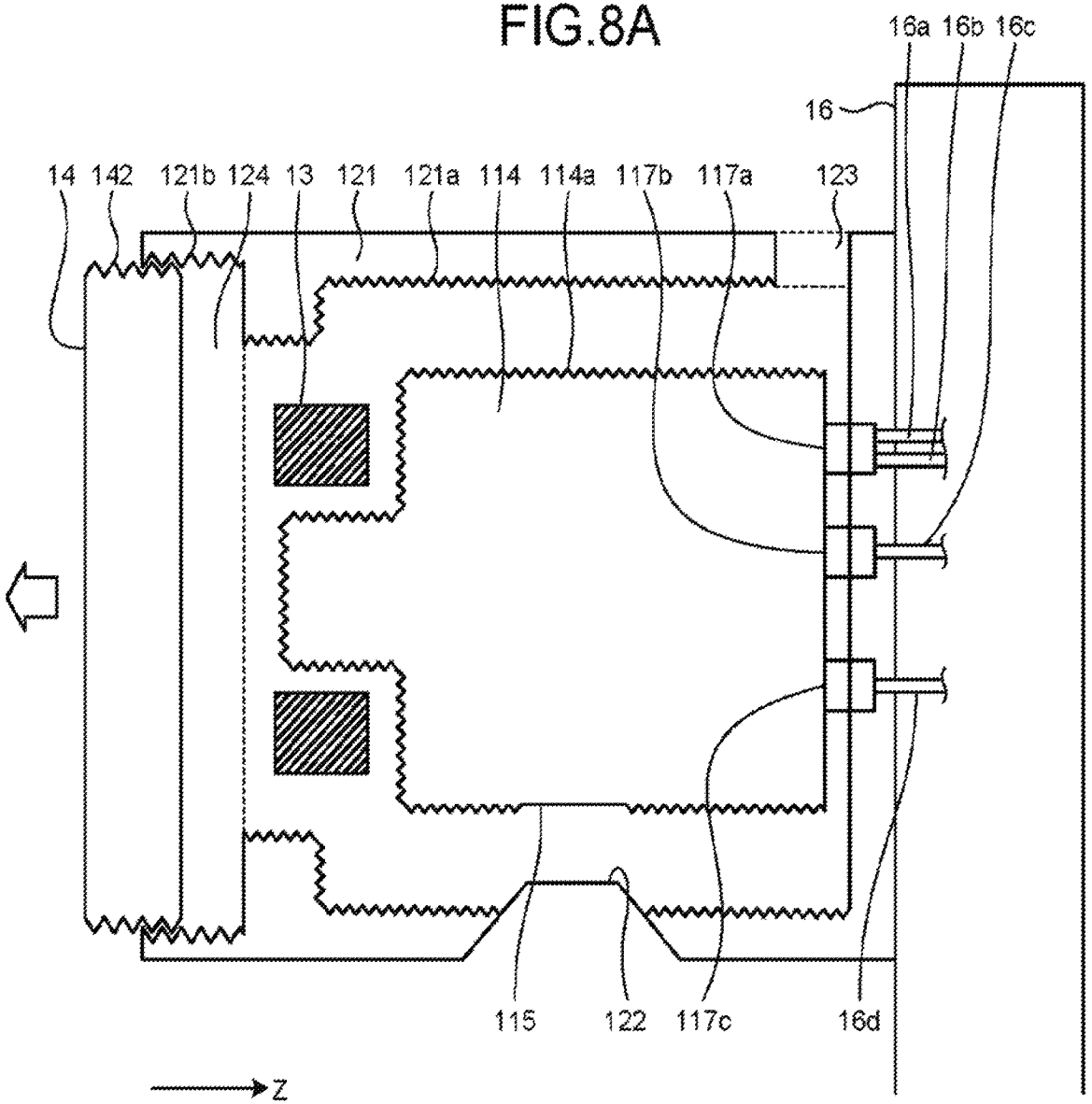
FIG. 8A is a diagram that illustrates an example of the procedure to replace the insert according to the first embodiment.

First, as illustrated in FIG. 8A, a person (hereafter, operator) who performs a work to replace the insert 11 removes the blower 14 provided in the opening 124. For example, the operator rotates the blower 14 in a direction opposite to the direction for attaching the blower 14 to the housing 12, thereby removing the blower 14 as indicated by an arrow in FIG. 8A. Here, FIG. 8A is a diagram that illustrates an example of the procedure to replace the insert 11 according to the first embodiment. After the blower 14 is removed, the operator pulls the stator coil 13 out through the opening 124.

Figure 8B:
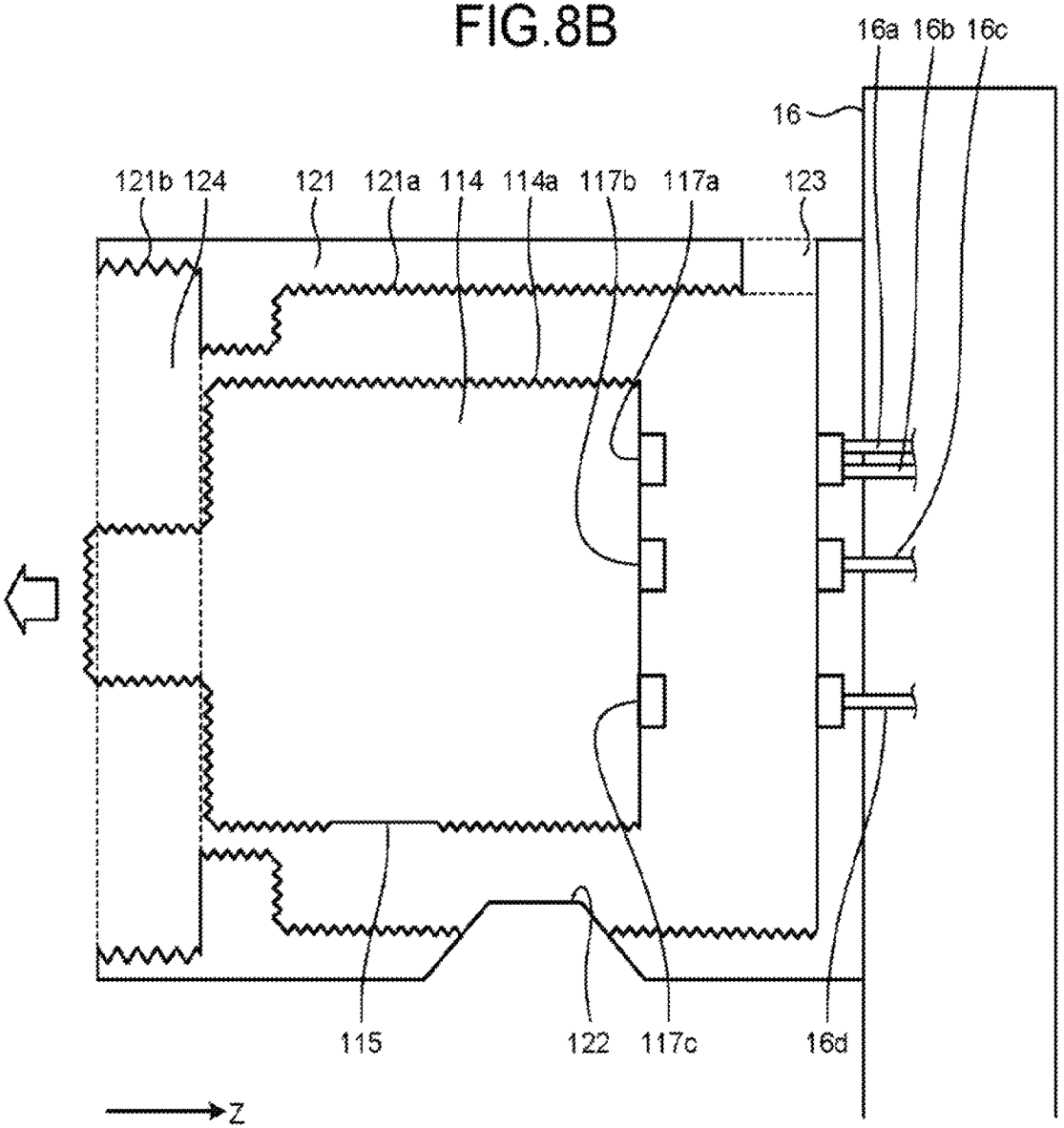
FIG. 8B is a diagram that illustrates an example of the procedure to replace the insert according to the first embodiment.

Next, as illustrated in FIG. 8B, the operator pulls the insert 11 out from the opening 124. Here, for example, the terminals included in the fixer 117*a*, the fixer 117*b*, the fixer 117*c*, the hose 16*a*, the hose 16*b*, the cable 16*c*, and the cable 16*d* are connectors that are pulled out from the terminals in pair to be disconnected. Furthermore, the fixer 117*a*, the fixer 117*b*, and the fixer 117*c* are provided on one end of the insert 11 at the side of the rotary frame 16 (the +Z direction side in FIG. 8B). Therefore, the operator pulls the insert 11 to the −Z direction side in FIG. 8B so as to easily remove the insert 11 from the rotary frame 16. Here, FIG. 8B is a diagram that illustrates an example of the procedure to replace the insert 11 according to the first embodiment.

Then, the operator attaches the new insert 11, which is different from the removed insert 11, or the insert 11 that has been removed and repaired, to the rotary frame 16. Specifically, the operator pushes the terminals included in the fixer 117*a*, the fixer 117*b*, and the fixer 117*c* of the insert 11 into the terminals included in the hose 16*a*, the hose 16*b*, the cable 16*c*, and the cable 16*d* of the rotary frame 16 to fix the insert 11 to the rotary frame 16. Then, the operator assembles the removed stator coil 13 in the housing 12 again. Then, the operator attaches the removed blower 14 at the side of the opening 124 of the housing 12 again.

As described above, according to the first embodiment, the housing 12 is fixed to the rotary frame 16 that is rotatable, and it has the opening 124 at the side opposite to the side facing the rotary frame 16. The insert 11 is assembled inside the housing 12, and it is removably attached to the rotary frame 16 through a fixer provided at one end. Furthermore, the insert 11 includes: the cathode 111 that generates the thermal electron E; and the anode 112 that receives collision of the thermal electron E to generate the X-ray R. The stator coil 13 is assembled inside the housing 12 to rotate the anode 112. The blower 14 is removably attached to the side of the opening 124 of the housing 12 to flow air into the housing 12.

Therefore, in the X-ray CT apparatus 1 according to the first embodiment, the insert 11 is pulled out from the side of the opening 124 of the housing 12 so that the insert 11 may be removed from the rotary frame 16, and the insert 11 is pushed into the housing 12 so that the insert 11 may be attached to the rotary frame 16. That is, in the X-ray CT apparatus 1, the insert 11 may be easily replaced through the opening 124 included in the housing 12.

Furthermore, in the X-ray CT apparatus 1 according to the first embodiment, the insert 11 is cooled with air that is flown into the housing 12 by the blower 14. Therefore, as the X-ray CT apparatus 1 does not have a configuration such that the area surrounding the insert 11 is filled with coolant, the insert 11 is easily replaceable.

Furthermore, in the X-ray CT apparatus 1 according to the first embodiment, when the insert 11 breaks down, only the insert 11 may be easily replaced. That is, in the X-ray CT apparatus 1, when the insert 11 breaks down, it does not need to be replaced together with the housing 12. Therefore, the X-ray CT apparatus 1 may reduce costs of components to replace the insert 11.

Furthermore, when only the insert 11 is replaced, a replaced component is lightweight as compared with a case where the insert 11 is replaced together with the coolant with which the area surrounding the insert 11 is filled and the housing 12. Therefore, the X-ray CT apparatus 1 may reduce workloads of an operator who performs a replacing work and may reduce working costs.

Furthermore, in the X-ray CT apparatus 1 according to the first embodiment, the housing 12 does not need to shield against X-rays at the side of the rotary frame 16 when viewed from the anode 112. Specifically, as the rotary frame 16 is made of a metallic material such as aluminum, and the rotary frame 16 shields against X-rays; therefore, there is no need to use lead for the surface of the housing 12 abutting the rotary frame 16. Alternatively, the surface of the housing 12 abutting the rotary frame 16 may be an opening. Therefore, the X-ray CT apparatus 1 may reduce the amount of lead used to make the rotary unit lightweight and may reduce environmental burdens.

In the case explained according to the above-described first embodiment, the grooves perpendicular to the flowing direction Zf of air are provided on the outer surface of the insert 11 and the inner surface of the housing 12. Conversely, in the case explained according to a second embodiment, grooves are provided along the flowing direction Zf of air on the outer surface of the insert 11 and the inner surface of the housing 12. Here, grooves along the flowing direction Zf of air according to the second embodiment may be provided in addition to the grooves perpendicular to the flowing direction Zf of air or may be provided instead of the grooves perpendicular to the flowing direction Zf of air.

Figure 9:
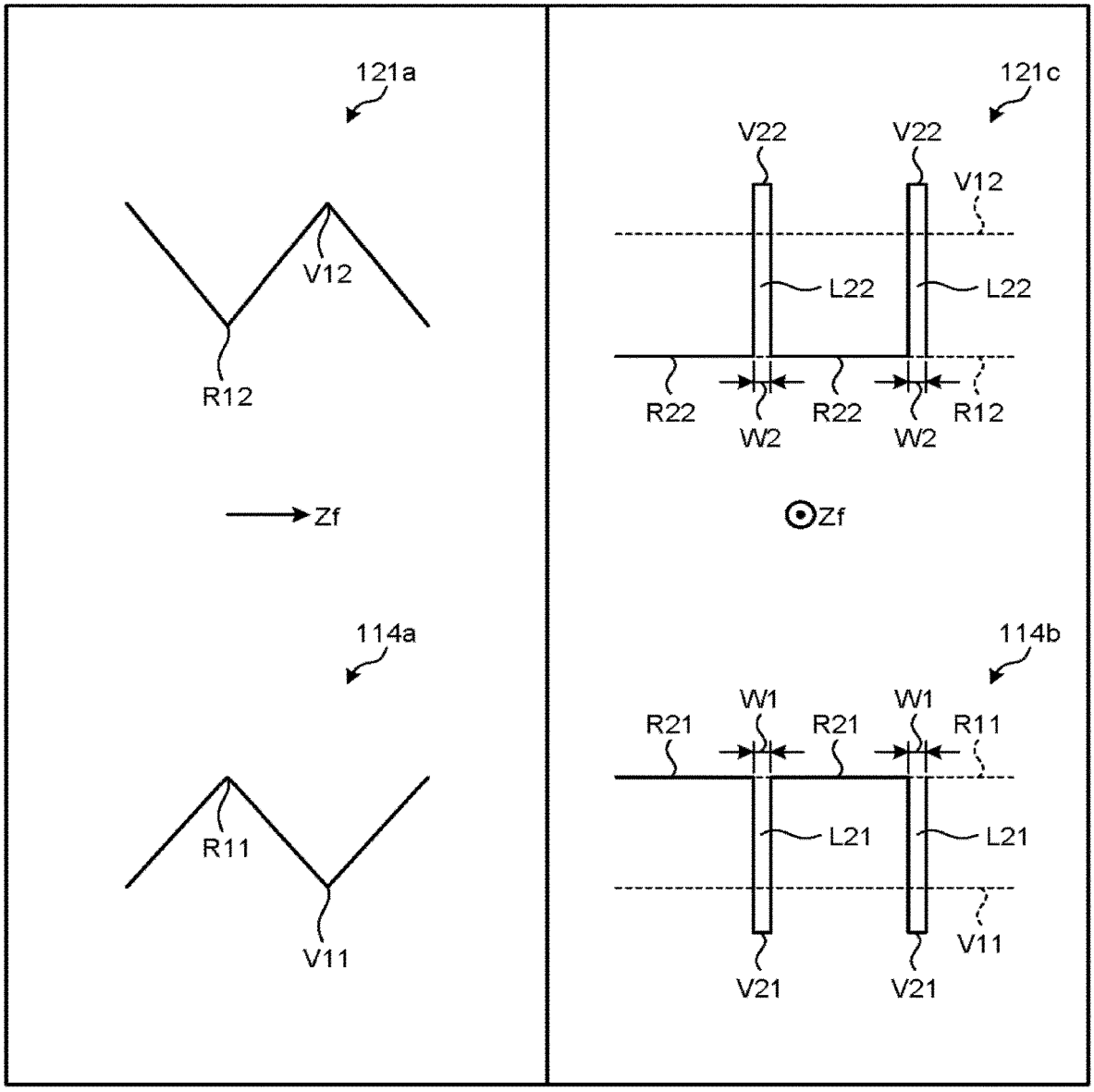
FIG. 9 is a diagram that illustrates an example of the shape of grooves according to a second embodiment.

The X-ray CT apparatus 1 according to the second embodiment has the same configuration as that of the X-ray CT apparatus 1 illustrated in FIG. 1. Therefore, a part having the same configuration as that described in the first embodiment is attached with the same reference numeral in FIG. 1, and explanation is omitted. With reference to FIG. 9, grooves included in the insert 11 and the housing 12 are explained below in detail. FIG. 9 is a diagram that illustrates an example of the shape of grooves according to the second embodiment.

The left section of FIG. 9 is an enlarged view of part of the groove 114*a* and the groove 121*a* illustrated in FIG. 6. When the blower 14 blows air into the housing 12, the air flows in the direction (the flowing direction Zf of air) indicated by the arrow in the left section of FIG. 9. That is, the groove 114*a* and the groove 121*a* are grooves perpendicular to the flowing direction Zf of air. Specifically, the groove 114*a* is configured by alternately repeating a ridge R11 and a valley V11. Furthermore, the groove 121*a* is configured by alternately repeating a ridge R12 and a valley V12.

The right section of FIG. 9 is a cross-sectional view of the groove 114*a* and the groove 121*a* on the plane perpendicular to the flowing direction Zf of air. In the right section of FIG. 9, the groove 114*a* made up of the ridge R11 and the valley V11 and the groove 121*a* made up of the ridge R12 and the valley V12 are indicated by dashed lines, and a groove 114*b* made up of a ridge R21 and a valley V21 and a groove 121*c* made up of a ridge R22 and a valley V22 are indicated by solid lines. As illustrated in the lower right section of FIG. 9, the groove 114*b* is formed such that it intersects with the groove 114*a* made up of the ridge R11 and the valley V11. Furthermore, as illustrated in the upper right section of FIG. 9, the groove 121*c* is formed such that it intersects with the groove 121*a* made up of the ridge R12 and the valley V12.

Specifically, as illustrated in the lower right section of FIG. 9, the groove 114*b* provided on the outer surface of the insert 11 is a groove along the flowing direction Zf of air, and it is formed by alternately repeating the ridge R21 and the valley V21. Furthermore, the groove 121*c* provided on the inner surface of the housing 12 is a groove along the flowing direction Zf of air, and it is formed by alternately repeating the ridge R22 and the valley V22.

Here, the groove 114*b* is filled with coolant L21. Furthermore, the groove 121*c* is filled with coolant L22. Here, the coolant L21 and the coolant L22 may be the same type of liquid or may be different types of liquids. For example, part of the coolant L1 supplied through the hose 16*a* may be used as the coolant L21 and the coolant L22, or a liquid supplied through a path different from the hose 16*a* separately from the coolant L1 may be used.

For example, part of the coolant L1 supplied through the hose 16*a* is first branched at the fixer 117*a*, and it adheres as the coolant L21 to the outer surface of the insert 11. Then, the coolant L21 enters the groove 114*b*. Here, the coolant L21 moves inside the groove 114*b* due to a capillary action so as to spread over the outer surface of the insert 11.

Here, a groove width W1 of the groove 114*b* is defined such that a capillary action occurs in the groove 114*b*. Furthermore, to improve a wetting performance, the material of the insert 11 (the chassis 114) is determined in accordance with the type of the coolant L21, or the type of the coolant L21 is determined in accordance with the material of the insert 11 (the chassis 114). Furthermore, as the groove 114*b* is formed to be deeper than the groove 114*a* as illustrated in FIG. 9, the coolant L21 may move in the groove 114*b* without being interrupted by the groove 114*a* even though both the groove 114*a* and the groove 114*b* are provided on the outer surface of the insert 11 such that they intersect with each other.

The coolant L21 spreads and evaporates on the outer surface of the insert 11. Here, the coolant L21 absorbs heat of evaporation from the insert 11 to cool the insert 11. That is, the groove 114*b* facilitates removal of heat from the insert 11.

Furthermore, for example, the coolant L22 is first delivered to inside the housing 12 via a hose that leads to the inside of the housing 12 through the heat release opening 123, and then the coolant L22 adheres to the inner surface of the housing 12. Then, the coolant L22 enters the groove 121*c*. Here, the coolant L22 moves in the groove 121*c* due to a capillary action, and it spreads over the inner surface of the housing 12.

Here, a groove width W2 of the groove 121*c* is defined such that a capillary action occurs in the groove 121*c*. Furthermore, to improve a wetting performance, the material of the housing 12 (the chassis 121) is determined in accordance with the type of the coolant L22, or the type of the coolant L22 is determined in accordance with the material of the housing 12 (the chassis 121). Furthermore, as the groove 121*c* is formed to be deeper than the groove 121*a* as illustrated in FIG. 9, the coolant L22 may move in the groove 121*c* without being interrupted by the groove 121*a* even though both the groove 121*a* and the groove 121*c* are provided on the inner surface of the housing 12 such that they intersect with each other.

The coolant L22 spreads and evaporates on the inner surface of the housing 12. Here, the coolant L22 absorbs heat of evaporation from the housing 12 to cool the housing 12. Furthermore, as the temperature of the housing 12 is decreased, the air flowing inside the housing 12 is cooled, and an air with a low temperature is delivered to the neighborhood of the insert 11. That is, the groove 121*c* facilitates removal of heat from the insert 11.

Although the first and the second embodiments are explained above, various different embodiments may be implemented other than the above-described first and second embodiments.

In the explanation according to the above-described embodiment, the chassis 121 of the housing 12 is made of lead. However, this is not a limitation on the embodiment. For example, the chassis 121 may be made of a resin having a heat resistance property. Examples of such a resin include polyethersulfone, polysulfone, or polyimide. Thus, the chassis 121 is easily processed so that the groove 121*a*, the groove 121*b*, the groove 121*c*, and the like, may be easily formed. Furthermore, in this case, the chassis 121 may have a two-layer structure of PES including the groove 121*a*, the groove 121*b*, the groove 121*c*, and the like, and lead for shielding against X-rays.

Furthermore, for example, the chassis 121 may be made of a plastic including an X-ray shielding metal. This allows the chassis 121 to shield against the X-rays R generated by the anode 112. Here, a metal such as lead or tungsten may be selected as the X-ray shielding metal. Furthermore, as the plastic, any resin having a heat resistance property may be selected. For example, the chassis 121 is made of a resin such as polyethersulfone, polysulfone, or polyimide. Moreover, the chassis 121 may be made of plastics (CFPR) that have a heat resistance property and that are reinforced with carbon fibers.

Furthermore, in the explanation of the case according to the above-described embodiment, the opening 124 of the housing 12 is provided at the side opposite to the side facing the rotary frame 16 (gantry base). However, this is not a limitation on the embodiment. For example, when the housing 12 has a cylindrical shape, the opening 124 may be provided on a side surface of the housing 12. For example, the housing 12 may have the X-ray window 122 illustrated in FIG. 4 on its side surface and have the opening 124 on the side surface on the opposite side of the X-ray window 122.

According to at least one of the above-described embodiments, the insert is easily replaceable.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An X-ray CT apparatus comprising:

a rotatable gantry base;

a housing that is fixed to the gantry base and that has an opening;

an insert that is removably located in the housing and that includes a cathode that generates a thermal electron and an anode that receives collision of the thermal electron to generate an X-ray; and a blower that is removably attached to a side of the opening to flow air into the housing.

2. The X-ray CT apparatus according to claim 1, wherein the housing has the opening on a side opposite to a side facing the gantry base.

3. The X-ray CT apparatus according to claim 1, wherein the insert is provided in the housing and is removably fixed to the gantry base through a fixer that is provided at one end.

4. The X-ray CT apparatus according to claim 1, further comprising a stator coil that is provided in the housing to rotate the anode.

5. The X-ray CT apparatus according to claim 1, wherein an outer surface of the insert is provided with a groove perpendicular to a flowing direction of the air.

6. The X-ray CT apparatus according to claim 1, wherein an inner surface of the housing is provided with a groove perpendicular to a flowing direction of the air.

7. The X-ray CT apparatus according to claim 1, wherein an inner surface or an outer surface of the housing at the side of the opening is provided with a helical groove, a surface of the blower abutting the inner surface or the outer surface at the side of the opening is provided with a helical groove, and the helical groove of the housing is engaged with the helical groove of the blower so that the blower is fixed to the housing.

8. The X-ray CT apparatus according to claim 1, wherein an outer surface of the insert is provided with a groove along a flowing direction of the air.

9. The X-ray CT apparatus according to claim 1, wherein an inner surface of the housing is provided with a groove along a flowing direction of the air.

10. The X-ray CT apparatus according to claim 1, wherein the housing is made of a resin having a heat resistance property.

* * * * *